US005464128A

United States Patent [19]

Keller

[11] Patent Number: 5,464,128

[45] Date of Patent: Nov. 7, 1995

[54] ELECTRICALLY OPERATED DISPENSING APPLIANCE HAVING TWO ELECTRIC MOTORS FOR ADVANCING AND RETRACTING THRUST RODS

[76] Inventor: Wilhelm A. Keller, Obstgartenweg 9, CH-6402 Merlischachen, Switzerland

[21] Appl. No.: 114,824

[22] Filed: Sep. 2, 1993

[30] Foreign Application Priority Data

Sep. 2, 1992 [CH] Switzerland ..... 02759/92

[51] Int. Cl.[6] ..... B67D 5/42

[52] U.S. Cl. ..... 222/333; 318/38; 318/76

[58] Field of Search ..... 222/333, 390, 222/137, 135, 136, 386, 326; 604/155; 318/38, 76, 77, 79, 81, 66, 67, 68

[56] References Cited

U.S. PATENT DOCUMENTS

| | | | |
|---|---|---|---|
| 3,208,638 | 9/1965 | Frenzel et al. | 222/333 |
| 3,854,629 | 12/1974 | Blieberger | 222/333 |
| 4,180,187 | 12/1979 | Ben-Haim | 222/390 |
| 4,260,076 | 4/1981 | Bergman | 222/390 |
| 4,335,834 | 6/1982 | Zepkin | 222/390 |
| 5,203,476 | 4/1993 | Keller | 222/390 |

FOREIGN PATENT DOCUMENTS 463990 1/1992 European Pat. Off. .

OTHER PUBLICATIONS

Abstract of Japanese Patent No. JP 61-227868 for "Machine for Filling Filler Such as Joint Mortar", Published Oct. 9, 1986.

*Primary Examiner*—Andres Kashnikow
*Assistant Examiner*—Philippe Derakshani
*Attorney, Agent, or Firm*—Marks & Murase

[57] ABSTRACT

The electrically operated dispensing appliance comprises two electric motors (1, 26), one of the electric motors (1) acting upon the driving screw (70) through a first gear drive (2) having a greater reduction ratio in order to rotate the driving screw in the advancing direction, and the other one of the electric motors (26) acting upon the driving screw (70) through a second gear drive (27) having a smaller reduction ratio in the other direction in order to retract the driving screw for relieving a dispensing cartridge and in order to turn the driving screw back when the thrust rod(s) (15) are retracted in order to exchange the storage cylinders. A coupling member (3) is arranged between the first drive (1, 2) and the driving screw (70), and two coupling members (97, 102) are arranged between the second drive (26, 27) and the driving screw (70) and are connected to each other by a pivoting lever (82) in such a manner that all of the coupling members are switched over from the advancing position to the retracting position and vice versa by moving the pivoting lever. Such an arrangement provides an effective discharge when the appliance is switched off, thus preventing an afterflow of the substance from the storage cylinders, and allows a relatively simple construction of the entire appliance.

19 Claims, 6 Drawing Sheets

ELECTRICALLY OPERATED DISPENSING APPLIANCE HAVING TWO ELECTRIC MOTORS FOR ADVANCING AND RETRACTING THRUST RODS

BACKGROUND OF THE INVENTION

The present invention refers to an electrically operated dispensing appliance, in which said electric drive acts either upon at least one thrust rod for a storage cylinder via a driving screw or upon at least one piston rod cooperating with a feed cylinder.

In dispensing appliances, whether they are manually, pneumatically, or electrically operated, there is a risk that when the thrust rod and thus the feed piston is advanced in the storage cylinder, the latter is forced apart more or less according to the material, so that when the drive is stopped and the forward pressure is discontinued, the tension of the cartridge is released and the substance contained therein keeps flowing out.

On this background, it is a first object of the present invention to provide an efficient discharge of the electric advance in order to prevent any afterflow. Another object which is specific to electrically operated dispensing appliances is to manufacture the corresponding electric drive as simply and economically as possible while still being reliable. These objects are attained by an electrically operated dispensing appliance, wherein the electric drive comprises two electric motors, one of the electric motors acting upon the driving screw in order to rotate it in the advancing direction, and the other one of the electric motors acting upon the driving screw in order to retract it for a cartridge tension discharge, and in order to turn it back when the thrust rod(s) are retracted in order to exchange the storage cylinders.

SUMMARY OF THE INVENTION

Accordingly, a first electric motor is provided for the advance of the driving screw, a reducing gear with a high reduction ratio being provided between the motor and the driving screw, and a second electric motor which is intended for the cartridge tension discharge (i.e, reduction of pressure within the cartridge) and, as the case may be, for the retraction of the drive screw, a reducing gear with a smaller reduction ratio being provided between the second electric motor and the driving screw for faster action upon the driving screw. The two motors are coupled to the driving screw by means of clutches in such a manner that no changeover is effected during the discharge, but the clutches are changed over for a full retraction of the thrust rods. Further embodiments are defined in the dependent claims.

BRIEF DESCRIPTION OF THE DRAWINGS

The invention is explained in more detail hereinafter with reference to drawings of preferred embodiments.

DETAILED DESCRIPTION OF THE INVENTION

Figure 1:
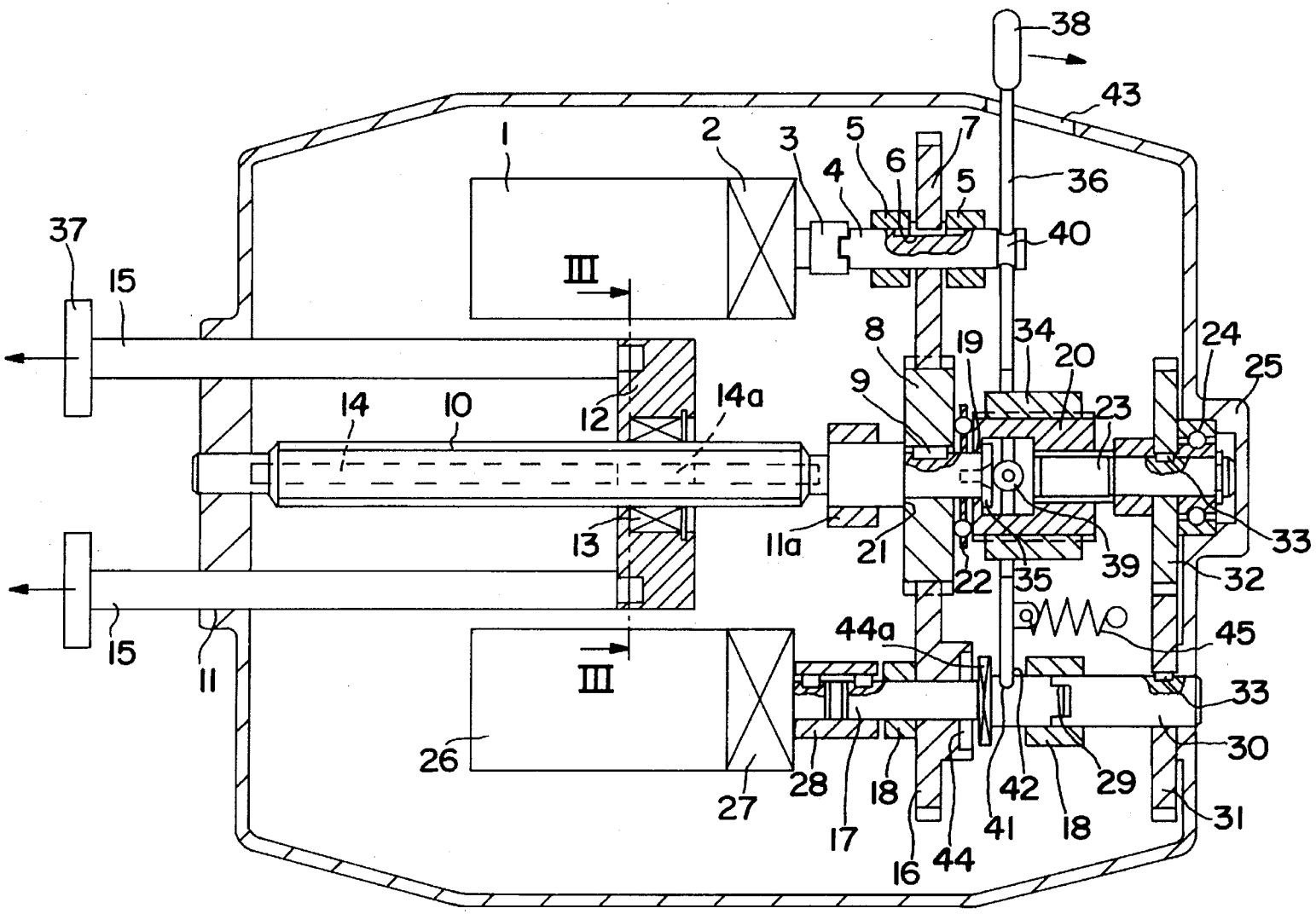
FIG. 1 shows a first embodiment of the invention schematically and in a sectional view.

The two embodiments of electrically operated dispensing appliances of the invention shown in the drawings are represented purely schematically, only the mechanical part being shown, essentially. In the first embodiment according to FIGS. 1, 2, and 3, the first electric motor 1 drives a first displaceable bearing neck 4, which is journalled in bearings 5, by a first planetary gear ("reduction gear drive") having a high reduction ratio via a first claw clutch 3. The first reduction gear drive 2 is flange-mounted to the first electric motor 1. By a nose key 6, a first gearwheel 7 is driven which is in active engagement with central gearwheel 8. By a wedge 9, said central gearwheel 8 thus drives driving screw 10 which may be in the form of a trapezoidal or a buttress thread screw, and which is supported in bearings 11 and 11*a*, respectively, and is axially displaceable.

Figure 3:
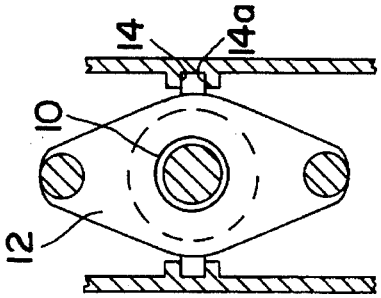
FIG. 3 shows a cross-section according to line III—III of FIG. 1.

Driving screw 10 acts upon a slide 12 which is provided with a rotationally secured bushing 13 and is guided by two guiding cams 14*a* through two longitudinal guidings 14 in the housing, as appears in FIG. 3. The slide is particularly advantageous if the cross-sectional ratio of the storage cylinders is different from 1:1 and thus different pressures of the two thrust rods are present. In this case, the slide will take up the unequal pressures, i.e. the tilting moment acting upon the driving screw.

By rotation of driving screw 10, an axial displacement of slide 12 is effected. In the present embodiment, two thrust rods 15 are arranged on the slide which are each provided with a thrust piece 37 acting upon the feed pistons of a double cartridge (not represented here). Such double cartridges are not actually an object of the present invention and have been described in detail, e.g., in EP-A-294,672 of the same applicant.

However, the electric dispensing appliance by the invention is not limited to the use of double cartridges and is also suitable for single or multiple cartridges. Moreover, in another, non-represented embodiment, driving screw 10 may act upon one or several piston rods instead of thrust rods, the piston rods cooperating with feed cylinders which are connected to storage containers. In this embodiment, the retraction of the driving screw during the exchange of the storage containers is not necessary.

Central gearwheel 8, on the other hand, drives the second gearwheel 16 which is freely rotatably guided on the second displaceable bearing neck 17 which is journalled in bearings 18. In the position shown in FIG. 1, the second gearwheel 16 does indeed rotate, but it has no influence upon the second bearing neck 17.

The end 19 of driving screw 10 opposite the cartridges is freely journalled in a screw socket 20 in which a threaded stem 23 engages. Screw socket 20 is rotationally secured by guidings 34. By the advance of thrust rods 15, high axial forces acting upon driving screw 10 are created. The forces are transmitted to screw socket 20 by shoulder 21 and thrust bearing 22 and are discharged from there to threaded stem 23 which is supported in thrust bearing 24 on housing 25 with rolling friction. It follows from the foregoing that when motor 1 is switched on, the latter acts upon central gearwheel 8 via the first gearwheel 7 and thus drives driving screw 10 in the dispensing direction, while the second gearwheel 16 rotates freely.

When first motor 1 is switched off and the advance of thrust rods 15 is thereby interrupted, the second electric motor 26 is switched on by a non-represented electric circuit. The second motor drives the second bearing neck 17 by means of a second planetary gear 27 ("reduction gear drive") having a smaller reduction ratio than first planetary gear 2, e.g. a ten times smaller one, and by a clutch 28. The second reduction gear drive 27 is glange-mounted to the second electric motor 26. Freely rotating second gearwheel 16 is not influenced thereby, and thus the second gearwheel 16 has no action upon driving screw 10 as well as on motor 1 and planetary gear 2.

However, second bearing neck 17 rotates a journal 30 by means of claw clutch 29, the journal driving a third gearwheel 31 by wedge 33 which acts upon fourth gearwheel 32 which is connected to threaded stem 23. The driving action results in an axial displacement of screw socket 20 which is rotationally secured in guidings 34. Since the direction of rotation is opposed posed to the advancing direction, a retraction of driving screw 10 with all connected parts, i.e., slide 12, bushing 13 as well as thrust rods 15, is effected by carrier plate 35. However, the backward relieving motion of the driving screw is only of a short duration, resulting, e.g., in an axial displacement of the thrust rods in the order of a few millimeters. Subsequently, the operation is discontinued by switching off second motor 26.

This relieving stroke serves the purpose of preventing the afterflow of the material mentioned in the introduction. Since all of the movements are effected axially, central gearwheel 8 only receives an axial movement by the rotation of threaded stem 23 and therefore has no action upon first planetary gear 2. When first electric motor I is again actuated for advancing thrust rods 15, the entire previously effected relieving motion is simultaneously returned to the starting position by second motor 26, whereby the device is again ready for a relieving stroke. Due to the smaller reduction ratio of second planetary gear 27, the relieving stroke is effected substantially faster than the advance.

In order to exchange the cartridge, it is necessary to retract the thrust rods completely. On one hand, a substantially smaller force is required for this purpose than for the advance and the dispensing of the substance, and on the other hand it is useful to effect the retraction substantially faster than the advance, which is why planetary gear 27 has a smaller reduction ratio. In order to retract the thrust rods, pivot lever 36 is brought from the position shown in FIG. 1 to that of FIG. 2. Pivot lever 36 with handle 38 is hinged on an articulation 39 and engages the end 40 opposite claw clutch 3 of the first bearing neck 4 while its end 41 opposite handle 38 engages in a groove 42 of second bearing neck 17. Moreover, the pivot lever 30 passes through an opening 43 of housing 25. When the pivot lever is changed over from the position of FIG. 1 to that of FIG. 2, first bearing neck 4 is disengaged from first claw clutch 3 and second bearing neck 17 is simultaneously disengaged from second claw clutch 29 and is inserted by its other end 44*a*, which is in the form of a coupling cam, in a recess 44 of second gearwheel 16.

When second motor 26 is switched on, second bearing neck 17 is set into rotation by means of clutch 28, and therewith second gearwheel 16 by the claw clutch arrangement and thus central gearwheel 8 with wedge 9, i.e., opposed to the screw advancing direction. Since the first bearing neck 4 is disengaged, there is no influence on planetary gear 2 and first motor 1. Since the claws of second claw clutch 29 are disengaged as well, the rotation of bearing neck 17 has no action upon journal 30 and the connected relieving members, and thus there is no axial influence upon driving screw 10.

Figure 2:
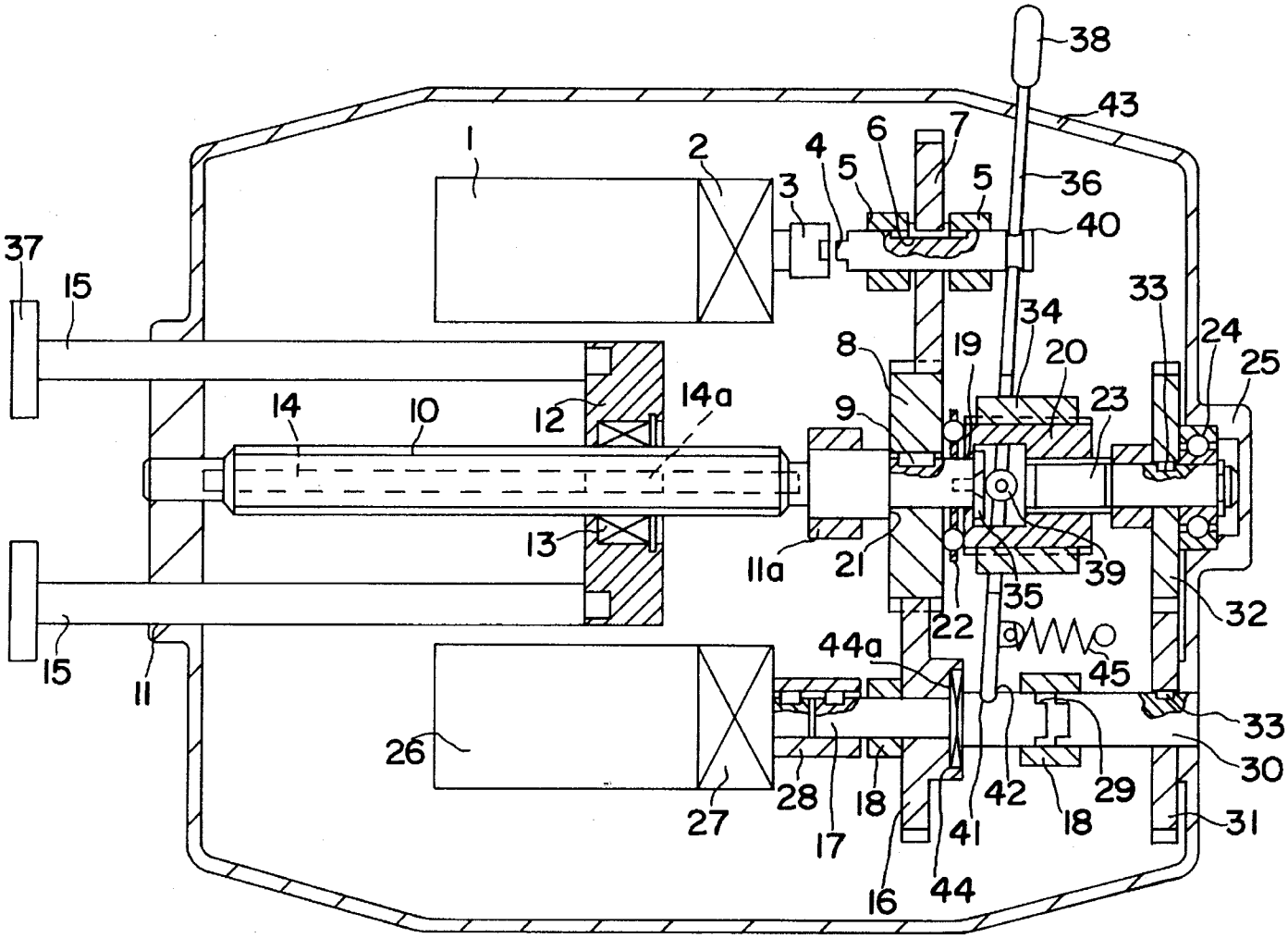
FIG. 2 shows the appliance of FIG. 1 in a second position.

In order to return to the advancing action, pivot lever 36 must be returned to the initial position, whereby all members connected thereto are brought to the position according to FIG. 1. Preferably, pivot lever 36 is subject to the action of a tension spring 45 which is hinged on the end of the pivot lever, on one hand, and on the housing, on the other hand. This allows an automatic return of the pivot lever to its initial position as soon as it is released.

Figure 4:
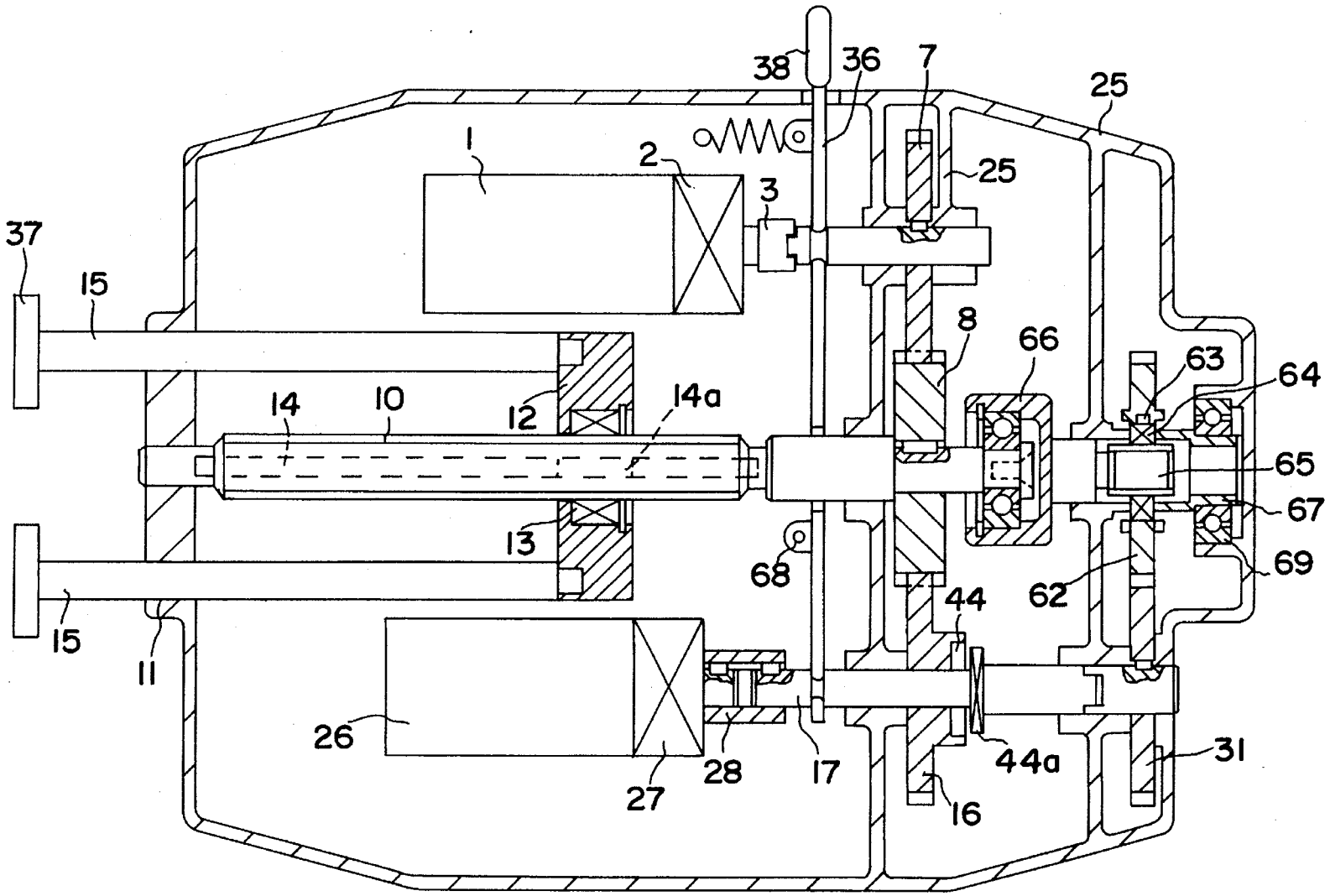
FIG. 4 shows an alternative embodiment of the appliance of FIG. 1.

FIG. 4 shows an alternative embodiment which provides some simplifications with respect to the relieving mechanism. The two gear assemblies from the two motors 1 and 26 to driving screw 10 are the same as in FIG. 1 or 2, as well as the two claw clutches and the clutch between second displaceable bearing neck 17 and second gearwheel 16. The third gearwheel 31, which is connected to displaceable second bearing neck 17 by means of second claw clutch 29, meshes with the fourth gearwheel 62 which is connected to a screw socket 64 by means of a wedge 63, the screw socket being arranged inside the fourth gearwheel in an axially stationary manner. The screw socket 64 acts upon a threaded bolt 65 which is connected to a bearing 66 in which the end of the driving screw is freely rotatively journalled. The fourth gearwheel 62 is supported on the housing by means of bushings 67 and a thrust bearing 69.

When second motor 26 is switched on, screw socket 64 is set into rotation by bearing neck 17 and gearwheels 31 and 62, and as it is axially stationary, threaded bolt 65 is thereby compulsorily displaced in the axial direction, and so is the driving screw with all parts of the appliance connected thereto.

In this example, pivot lever 36 is arranged between gearwheels 7, 8, 16 and first claw clutch 3 and clutch 28, respectively, and pivot point 68 is disposed below and beside the driving screw in FIG. 4.

Figure 5:
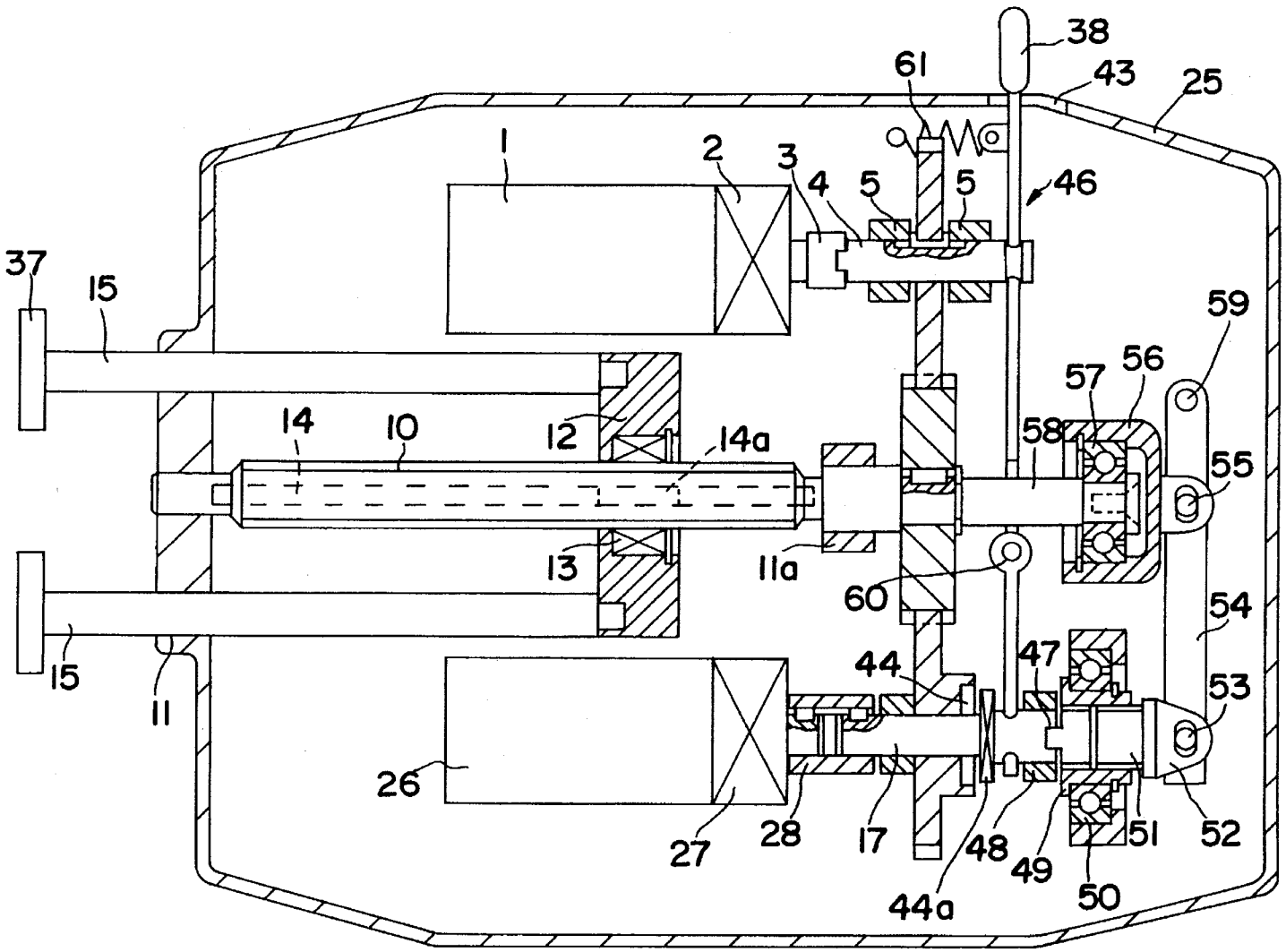
FIG. 5 shows a cross-section of a second embodiment of the dispensing appliance of the invention.

In FIG. 5, a second embodiment with another variant of the relieving device is represented, a number of gearwheels being omitted while a multiplication lever is built in. The entire advancing drive with the first electric motor, the first planetary gear, the first, central, and second gearwheels as well as the second electric motor and the second planetary gear and driving screw 10 with the members connected thereto are the same as in the first two embodiments. Likewise, also the retracting member for complete retraction of the thrust rods in the case of a cartridge exchange are the same, i.e., when pivot lever 46 is changed over to a second, non-represented position, the first claw clutch is disengaged and the second one is brought from the freely rotating position to a position in which it is connected to second gearwheel 16.

When first electric motor 1 is switched off and second electric motor 26 is switched on for the relieving stroke, second bearing neck 17, which is held in bearings 48, sets a second screw socket 49 in rotation by the claws of claw clutch 47, the screw socket being journalled in a thrust bearing 50. Screw socket 49 drives a threaded stem 51 having a bearing 52 which is connected to a lever 54 by means of an articulation 53 and is thereby rotationally secured. Lever 54 is connected to bearing cap 56 of another thrust bearing 57 by means of a journal 55. The shaft end 58 of driving screw 10 is held in the thrust bearing and is allowed to rotate freely in thrust bearing 57. Shaft end 58 of the driving screw is connected to central gearwheel 8 by wedge 9. In addition, lever 54 is pivotable around its pivot point 59.

Pivot lever 46, as lever 36, is provided with a handle 38 is and pivotable around a pivot point 60 and engages both first bearing neck 4 and second bearing neck 17 in order to disengage the first and the second claw clutch. Moreover, the pivot lever is connected to a tension spring 61 near its handle, the spring being hinged on the pivot lever and on the housing.

When advancing motor 1 is switched off and second motor 26 is switched on, second screw socket 49 is set into rotation by second claw clutch 47, the rotation being transmitted to threaded stem 51. As the threaded stem is rotationally secured by lever 54, it is drawn away from the second motor as motor 26 rotates in the appropriate direction. By lever 54, shaft end 58 and thus driving screw 10 with the members connected thereto are drawn back, i.e. away from the cartridge. The lever action allows to select a weaker and thus smaller motor for the second drive, the smaller power of the motor being at the price of a longer stroke. It is understood that the leverage of lever 54 can be freely chosen within certain limits.

Figure 6:
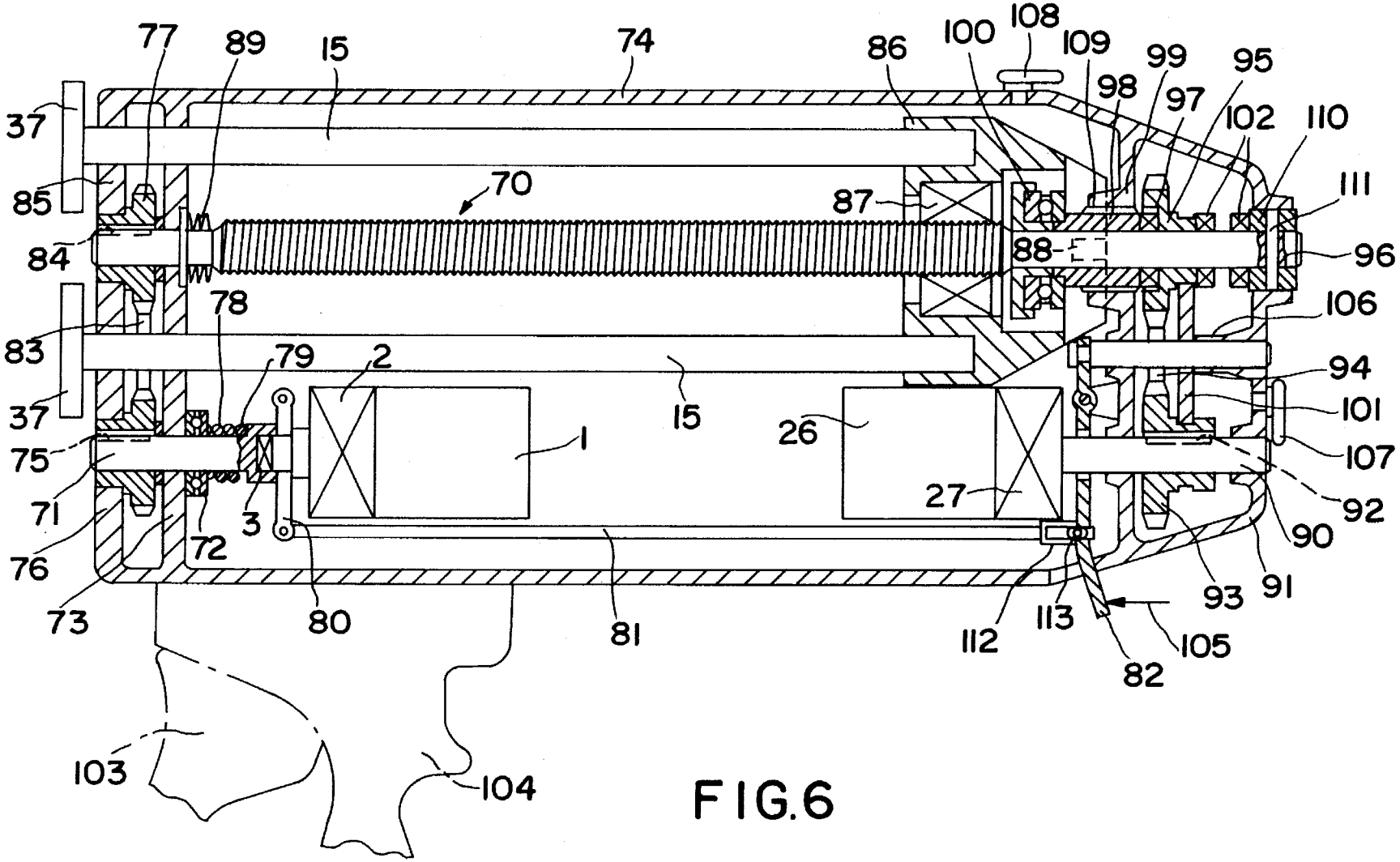
FIG. 6 shows a cross-section of a further embodiment of the invention.

In FIG. 6, another preferred embodiment is shown in which, in contrast to the first embodiments, the two drive motors I and 26 are disposed on the same side of screw 70, whereby a slimmer, handier appliance is obtained. Drive motor 1 with the first planetary gear 2 having a high gear reduction drives displaceable bearing neck 71 by first claw clutch 3, the bearing neck being supported in a bearing 72 and being led through a wall 73 of housing 74. The bearing neck is connected to a first chain wheel 76 by a wedge 75, the chain wheel meshing via a chain or a toothed belt 83 with a second chain wheel 77 which is secured to driving screw 70 by means of a wedge 84, both chain wheels 76 and 77 being journalled in the front housing wall 85.

Bearing neck 71 is under the action of a pressure spring 78 which rests on a shoulder 79 arranged in the bearing neck and on bearing 72, in order to keep it under pressure until it is capable of engaging, after pivoting lever 82 has been manually released, in the gear shaft as soon as the respective positions for engagement correspond, i.e. as soon as the slowly rotating gear shaft has attained the correct position. The claw clutch is actuated by a short lever arm 80 which is connected by a connecting rod 81 to a guided pivotable lever 82 which projects from the housing and is pushed into its initial position by pressure spring 78.

Driving screw 70 acts upon a slide 86 which comprises a rotationally secured bushing 87 and which is guided by two guiding cams 88 in two longitudinal guidings in the housing as in the previous examples. Here also, two thrust rods 15 each having a thrust piece 37 are arranged on the slide in order to actuate the feed cylinders of a double cartridge. The driving screw is subject to the pressure of a spring 89 which rests on wall 73 of the housing and on a shoulder of the screw and which has the effect that threaded screw 70 can follow the stroke motion during the cartridge relieving stroke which is obtained by the backward rotation of screw socket 98.

Second electric motor 26 with second planetary gear 27 having a smaller reduction ratio acts upon a bearing neck 90 which is journalled in the rear housing wall 91 and to which a third chain wheel 93 is secured by a wedge 92. The third chain wheel acts upon a fourth chain wheel 95 which is attached to the rear end 96 of the driving screw by a chain or a toothed belt 94. The fourth chain wheel is connected by a clutch 97 to a screw socket 98 which rotates in a housing wall 99 by a thread 109. At its front end, the screw socket ends in a thrust bearing 100 whose front end is connected to the driving screw and which takes up the forces imparted to the latter.

Both chain wheels 93 and 95 are arranged on bearing neck 90 and on screw end 96, respectively, in an axially sliding manner and can be displaced simultaneously by means of a connecting piece 101 which is arranged at the end of pivoting lever 82 facing the appliance side. When the pivoting lever is swung out of the illustrated position, the part of claw clutch 102 which is arranged on the other side of the fourth chain wheel engages in the part of the claw clutch which is secured to driving shaft 110, the driving shaft being connected to screw end 96 by a driving pin 111, and the pivoting strokes being adjusted in such a manner that bearing neck 71 is disengaged first, chain wheel 95 being allowed to engage thereafter only. A spring 112 acts upon pivoting lever 82 in such a manner that the claws of chain wheel 95 and the claws of the shaft driver are engaged by corresponding intermediate members when the lever is pressed. Moreover, by actuating lever 82, spring 78 is preloaded until the engaging positions correspond and the claws can engage without resulting in a shock on the lever, slot 113 in the connecting piece of the connecting rod also contributing to its prevention.

For the advance, i.e., for dispensing, motor I is switched on by actuating switch 103 on handle 104, and screw 70 is driven by chain wheels 76 and 77, all elements being in the position as shown in FIG. 6 and clutch 97 being in engagement, whereby neither the third nor the fourth chain wheel move along.

When the actuating switch is released, motor 1 is switched off as in the previous examples, and motor 26 is operated for the relieving stroke. The third and the fourth chain wheel are thus set into motion, and this results in a rotation of the screw and a backward sliding motion of screw socket 98 on the housing wall and thus of the screw along with slide 86 with the thrust rods in order to prevent an afterflow of the substance.

In order to retract the thust rods completely for reloading the appliance, motor 1 could theoretically simply be commuted. As this motor is highly reduced, however, this is not useful, and therefore a substantially less reduced motor, which is also required for a very fast relieving stroke, is used for this purpose. To this end, pivoting lever 82 is pushed in the direction of arrow 105. Pivoting lever 82 acts upon connecting rod 81 and lever 80 and upon claw clutch 3, on one hand, whereby the connection to motor 1 is interrupted, and by chain wheels 93, 95 and against pressure spring 106 upon claw clutch 102 at the screw end 96, on the other hand, in order to rotate the screw and to release the thrust rods by means of screw socket 87, the return motion being effected by pressure spring 89.

Furthermore, the housing comprises a first electric change-over switch 107 in order to cancel the operation of the relieving stroke, as well as a second electric change-over switch 108 in order to reverse the rotational direction of motor 26, i.e., of the screw. This allows either a fast return stroke or a fast entry into a—partially—empty cartridge.

Figure 7:
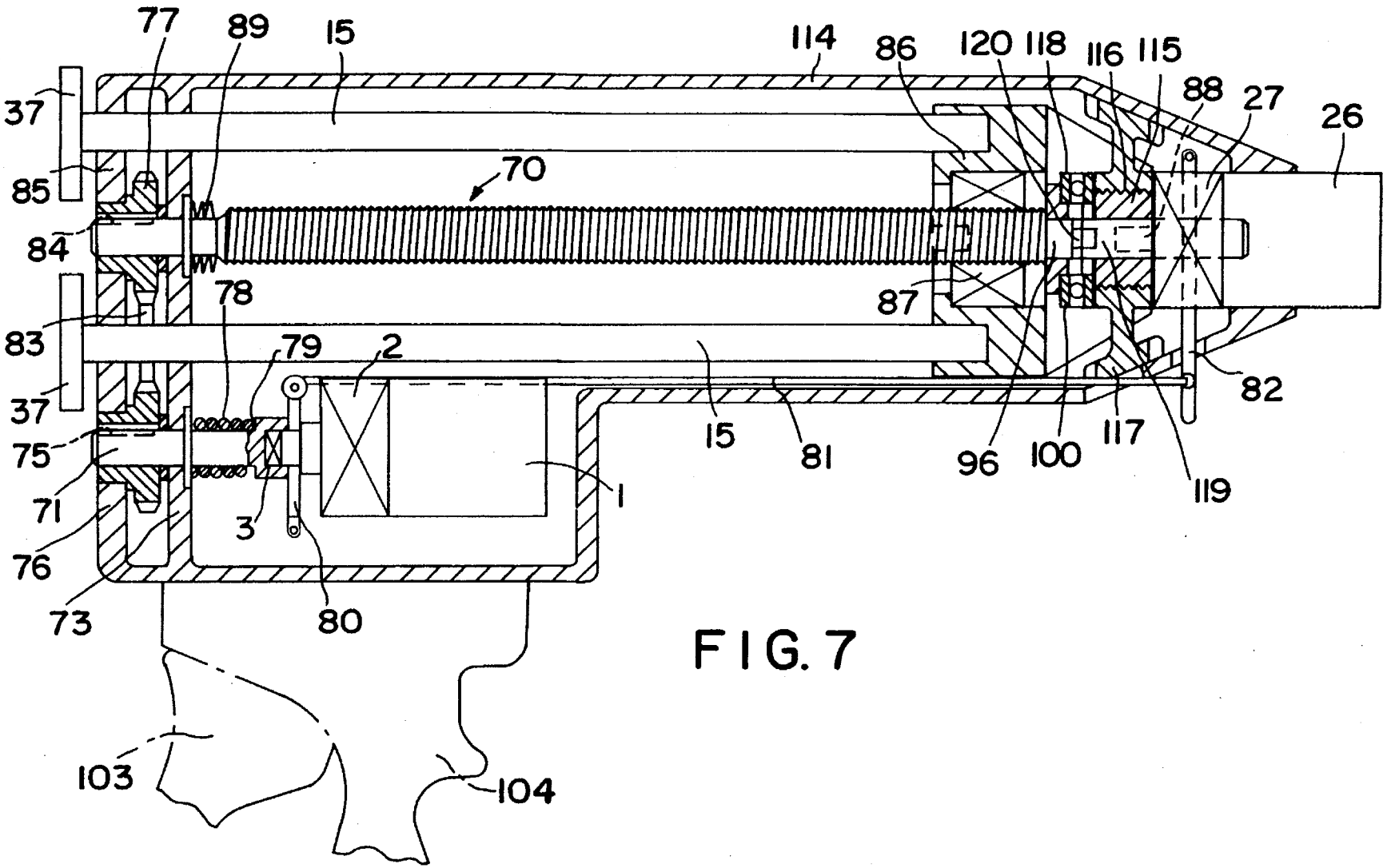
FIG. 7 shows a variant of the embodiment of FIG. 6.

In the variant of FIG. 7 the same parts have the same numerals as in FIG. 6 and have the same function. The two motors 1 and 26 are not arranged in line, but the second motor 26 with gear 27 is arranged in line with driving screw 70 at its end 96 and protudes from the end of the housing 114. Like in the previous embodiment the screw acts upon the slide 86 having the rotationally secured bushing 87 and which is guided by two guiding cams 88 in two longitudinal guidings in the housing. Here also, two thrust rods 15 each having a thrust piece 37 are arranged on the slide in order to actuate the feed cylinders of a double cartridge. The driving screw is subject to the pressure of a spring 89 which rests on wall 73 of the housing and on a shoulder of the screw and which has the effect that driving screw 70 can follow the stroke motion during the cartridge relieving stroke which is obtained by the backward rotation of screw socket 115.

Screw socket 115, which ends into thrust bearing 100, moves in a thread 116 in housing wall 117 and is connected over an outer claw clutch 118 to the bearing neck 119 of the second gear 27. In the shown position the bearing neck drives the screw socket for causing the relieving stroke. The driving screw's end 96, which is connected by an inner claw clutch 120 to bearing neck 119, is in the shown position coupled out.

Analogous to the previous example the claw clutch 3 at the first motor is connected via the short lever 80 and connecting rod 81 with pivoting lever 82, which is hinged to the housing and acting on bearing neck 119 for sliding it. When pressing upon pivoting lever 82 the bearing neck 119 is displaced and the outer claws of clutch 118 are moved out of engagement and the inner claws of clutch 120 into engagement, for enabling a fast return stroke or via, a not shown switch a fast entry into a—partially—empty cartridge. Simultaneously motor 1 is coupled out.

It follows from the above description that the variant of embodiment according to FIG. 7 is a mechanically particularly simple and efficient solution in which chain wheels and further transmission elements can be saved, without obtaining a bulky apparatus.

As already mentioned in the introduction, the driving screw does not have to be linked with two thrust rods, but the same driving mechanism can also be used for dispensing appliances with a single cartridge. On the other hand, the design is not limited upwardly to appliances having double cartridges either. Furthermore, neither the thrust pieces on the thrust rods nor the cross-sections of the storage cylinders of the cartridge have to be equal.

Moreover, the invention is not bound to a dispensing appliance having the illustrated and described storage cylinders which are arranged in a line with the thrust rods. The invention may also be used in dispensing appliances whose storage cylinders are arranged differently.

The electronic circuitry of the electric drive, i.e., of the electric motors of the appliance, is not represented, but a common circuit for such motors can be used for this purpose.

I claim:

1. An electrically operated dispensing appliance, in which an electric drive acts upon at least one thrust rod for a storage cylinder via a driving screw, wherein said electric drive comprises two electric motors, one of said electric motors acting upon said driving screw in order to rotate the driving screw in an advancing direction, and the other one of said electric motors acting upon said driving screw in order to retract the driving screw in a direction opposite to said advancing direction for discharging a pressure within a dispensing cartridge, and for exchanging said storage cylinder.

2. An electrically operated dispensing appliance, in which an electric drive acts upon at least one thrust rod for cooperating with a feed cylinder via a driving screw, wherein said electric drive comprises two electric motors, one of said electric motors acting upon said driving screw in order to rotate the driving screw in an advancing direction, and the other one of the electric motors acting upon said driving screw in order to retract the driving screw in a direction opposite to said advancing direction for discharging a pressure within a dispensing cartridge.

3. An electrically operated dispensing appliance, in which an electric drive acts upon at least one thrust rod for a storage cylinder via a driving screw, wherein said electric drive comprises two electric motors, one of said electric motors acting upon said driving screw in order to rotate the driving screw in an advancing direction, and the other one of said electric motors acting upon said driving screw in order to retract the driving screw in a direction opposite to said advancing direction for discharging a pressure within a dispensing cartridge, and for exchanging said storage cylinder;

wherein a first reduction gear drive having a first reduction ratio is flange-mounted on said first motor and a second reduction gear drive having a second reduction ratio is flange-mounted on said second motor, said first reduction ratio being greater than said second reduction ratio, and wherein a first coupling member is arranged between the first gear drive and said driving screw, and a second coupling member is arranged between the second gear drive and said driving screw, the first and second coupling members being connected to each other by a pivoting lever in such a manner that all of said coupling members can be switched from an advancing position to a retracting position or vice versa by moving said pivoting lever.

4. The dispensing appliance of claim 3, wherein said first coupling member is a first claw clutch one part of which belongs to said first gear drive and the other part of which belongs to a first displaceable bearing neck which is connected to said pivoting lever and to a first gearwheel, and wherein said coupling members belonging to said second gear drive comprise a clutch between said second gear drive and a second displaceable bearing neck which is also connected to said pivoting lever, and of a second claw clutch between said second bearing neck and a reciprocating member acting upon said driving screw, as well as of a clutch between said second bearing neck and a second gearwheel, said first bearing neck, while in engagement with said first gear, acting upon said driving screw by gearwheels in order to set said driving screw into rotation in the advancing position, said second bearing neck, while in engagement with said second gear drive, cooperating with said reciprocating member in order to retract said driving screw in the retracting position, and said second bearing neck being driven and setting said driving screw into rotation by means of said clutch and said gearwheels while said two claw clutches are disengaged in the retracting position.

5. The dispensing appliance of claim 1, wherein a longitudinally displaceable slide which is guided in a housing of the dispensing appliance and provided with a bushing is arranged around said driving screw to support said driving screw, and at least one thrust member being secured in said slide.

6. The dispensing appliance of claim 4, wherein said first and second gear drives comprise planetary gears and wherein said first gearwheel which is connectable to said first bearing neck and said second gearwheel which is connectable to said second bearing neck both mesh with a central gearwheel which is connected to said driving screw.

7. The dispensing appliance of claim 4, wherein in the relieving position, said second bearing neck acts through said second claw clutch upon a journal which acts, by means of a third and fourth gearwheel, upon a threaded stem belonging to said reciprocating member, said threaded stem engaging in a guided screw socket in which the end of said driving screw is supported in order to displace the driving screw longitudinally.

8. The dispensing appliance of claim 4, wherein in the relieving position, said second bearing neck acts through said second claw clutch upon a journal which acts, by means of a third and a fourth gearwheel, upon an axially stationary screw socket arranged in said fourth gearwheel and belonging to said reciprocating member which is meshing with a threaded bolt which is connected to a bearing receiving one end of said driving screw in order to displace the driving screw longitudinally.

9. The dispensing appliance of claim 4, wherein in the retracting position, said second bearing neck acts through said second claw clutch upon a rotatable but stationary screw socket in which a second threaded stem is arranged which is provided with an articulated bearing for a lever which is hinged on a bearing cap which is longitudinally displaceably guided in a housing of the dispensing appliance and in which the shaft end of said driving screw is supported in order to displace the driving screw longitudinally.

10. The dispensing appliance of claim 3, wherein a longitudinally displaceable slide which is guided in the housing and provided with a rotationally secured bushing is arranged around said driving screw, and at least one thrust member is secured in said slide.

11. The dispensing appliance of claim 3, further comprising an actuating switch means for switching the rotational direction of said screw and for disabling a retracting function of said other one of said electric motors.

12. The dispensing appliance of claim 3, wherein said first coupling member is a first claw clutch one part of which is connected to said first gear drive and the other part of which is connected to a first displaceable bearing neck which is connected to said pivoting lever and to a first chain wheel, and wherein said second coupling member comprises a second clutch between said second gear drive and a coupling part which is connected to said screw, said first bearing neck, while in engagement with said first gear drive, acting upon said driving screw by chain wheels in order to set the driving screw into rotation in the advancing direction.

13. The dispensing appliance of claim 3, wherein said first coupling member is a first claw clutch one part of which is connected to said first gear drive and the other part of which is connected to a first displaceable bearing neck which is connected to said pivoting lever and to a first chain wheel, and wherein said second coupling member comprises an inner claw clutch between the bearing neck of said second gear drive and said driving screw, and of an outer claw clutch between the bearing neck of said second gear drive and a screw socket moving in a thread in a wall of the housing and acting upon said driving screw, said bearing neck of the second gear drive being displaceable by said pivoting lever, said first bearing neck, while in engagement with said first gear drive, acting upon said driving screw by chain wheels in order to set it into rotation in the advancing direction, said screw socket, while in engagement with said second gear drive, cooperating with said driving screw in order to retract said driving screw in a retracting direction opposite said advancing direction.

14. The dispensing appliance of claim 12, wherein said two electric motors, as seen in the plane of said thrust rods, are arranged on the same side of said screw.

15. The dispensing appliance of claim 13, wherein said second electric motor is arranged in line with the driving screw.

16. An electrically operated dispensing appliance, comprising:

a driving screw operatively connected to at least one thrust rod for moving a thrusting member into a dispensing cartridge;

a first electric motor for rotating said driving screw for movement in an advancing direction;

a second electric motor for retracting said driving screw in a direction opposite said advancing direction;

a first drive means connecting said first electric motor to said driving screw for moving said driving screw at a first speed in the advancing direction upon rotation of said first electric motor; and a second drive means connecting said second electric motor to said driving screw for moving said driving screw at a second speed in a direction opposite said advancing direction upon rotation of said second electric motor, said second speed being greater than said first speed.

17. The dispensing appliance of claim 16, wherein said first drive means comprises a first reduction gear drive and said second drive means comprises a second reduction gear drive, said first reduction gear drive having a reduction ratio greater than said second reduction gear drive.

18. The dispensing appliance of claim 16, further comprising a first clutch means for disengaging a drive connection between said first electric motor and said driving screw, a second clutch means for disengaging a drive connection between said second electric motor and said driving screw, and a pivoting lever connected to said first and second clutch means, said pivoting lever having a first operative position for selectively disengaging said first clutch means and engaging said second clutch means, and a second operative position for selectively engaging said first clutch means and disengaging said second clutch means.

19. The dispensing appliance of claim 16, wherein said first electric motor is offset from a longitudinal axis of said driving screw, and said second electric motor is coaxial with said longitudinal axis of said driving screw.

* * * * *